US009262904B2

(12) United States Patent
Potter

(10) Patent No.: US 9,262,904 B2
(45) Date of Patent: Feb. 16, 2016

(54) PERSONAL IDENTIFICATION SYSTEM

(75) Inventor: John Potter, Nottinghamshire (GB)

(73) Assignee: G4S MONITORING TECHNOLOGIES LIMITED (GB)

( * ) Notice: Subject to any disclaimer, the term of this patent is extended or adjusted under 35 U.S.C. 154(b) by 0 days.

(21) Appl. No.: 14/238,427

(22) PCT Filed: Aug. 7, 2012

(86) PCT No.: PCT/GB2012/051912
§ 371 (c)(1),
(2), (4) Date: May 5, 2014

(87) PCT Pub. No.: WO2013/021193
PCT Pub. Date: Feb. 14, 2013

(65) Prior Publication Data

US 2014/0292519 A1 Oct. 2, 2014

(30) Foreign Application Priority Data

Aug. 11, 2011 (GB) ..... 1113823.7

(51) Int. Cl.
*G08B 1/08* (2006.01)
*G08B 21/18* (2006.01)
*G07C 9/00* (2006.01)

(52) U.S. Cl.
CPC ..... *G08B 21/18* (2013.01); *G07C 9/00174* (2013.01)

(58) Field of Classification Search
CPC .. G06F 19/323; G08B 21/22; G08B 21/0211; G08B 21/0269; G08B 21/0286; G08B 21/0288; G08B 21/18; G07C 9/00174
USPC ..... 340/539.13, 573.4, 572.1, 572.8, 572.9
See application file for complete search history.

(56) References Cited

U.S. PATENT DOCUMENTS 5,461,390 A * 10/1995 Hoshen ..... 340/573.4
5,627,520 A 5/1997 Grubbs (Continued)

FOREIGN PATENT DOCUMENTS

WO WO2006/039722 A2 4/2006

OTHER PUBLICATIONS

Great Britain Search Report, Dec. 7, 2011, GB1113823.7, 1 page, United Kingdom International Searching Authority.

(Continued)

*Primary Examiner* — Thomas Mullen

(57) ABSTRACT

A method of monitoring objects such as offenders, the method including the steps of: providing an electronic monitoring device for attachment to an object to be monitored; providing a tamper evident tether for attachment of the electronic monitoring device to the object to be monitored; attaching the electronic monitoring device to the object to be monitored using the tamper evident tether; and remotely monitoring the electronic monitoring device in order to monitor the location of the object. The method further includes the steps of: providing the tamper evident tether with a unique identifier; providing an electronic data store remote from the electronic monitoring device; recording the unique identifier for the tether in the electronic data store, together with information about the object to be monitored and/or the associated electronic monitoring device; and performing an interrogation step at least once after the date on which the electronic monitoring device is first attached to the object, to determine whether the tether associated with the electronic monitoring device has the same unique identifier as that recorded in the electronic data store.

15 Claims, 6 Drawing Sheets

(56) References Cited

U.S. PATENT DOCUMENTS

| | | | | |
|---|---|---|---|---|
| 5,731,757 | A * | 3/1998 | Layson, Jr. | 340/573.1 |
| 6,072,396 | A | 6/2000 | Gaukel | |
| 6,412,976 | B1 | 7/2002 | Dechery et al. | |
| 2002/0044058 | A1 * | 4/2002 | Heinrich et al. | 340/572.1 |
| 2007/0035401 | A1 * | 2/2007 | Bartz | 340/572.8 |
| 2007/0120687 | A1 * | 5/2007 | Lerch et al. | 340/572.9 |
| 2009/0051562 | A1 | 2/2009 | Potter et al. | |

OTHER PUBLICATIONS

PCT International Search Report and Written Opinion; mailing date, Nov. 27, 2012; 10 pages; PCT/GB2012/051912, European Patent Office.

* cited by examiner

PERSONAL IDENTIFICATION SYSTEM

The present application is a U.S. National Stage patent application of International Patent Application No. PCT/GB2012/051912, filed on Aug. 7, 2012, which claims priority to Great Britain Patent Application No. 1113823.7, filed on Aug. 11, 2011, with respect to each of which the priority is claimed and the disclosure is incorporated herein by reference in its entirety.

Due to a number of factors, including pressure on penitentiary systems, it has become common for offenders to be supervised outside of prison. Such offenders must be monitored to ensure that they are at a specific location when required, for example if the offender is under curfew. It is known to monitor offenders by means of an electronic monitoring device, which is attached to the offender and provides an indication of the offender's location.

Existing electronic monitoring devices are often designed to be tamper-evident, so that it can be seen whether any attempt to interfere with the device has been made.

There are difficulties with detecting tampering of known electronic monitoring devices. Tamper-evident straps may transmit indication that a strap has been removed, only for there to be no sign of removal upon inspection. With no physical evidence that the strap has been compromised it can be difficult to achieve prosecution for tampering. Straps and strap fasteners can be removed and replaced without showing signs of tampering.

What is required is an improved method of monitoring objects via an electronic monitoring system.

According to the present invention there is provided a method of monitoring objects such as offenders, the method including the steps of:

- providing an electronic monitoring device for attachment to an object to be monitored;
- providing a tamper evident tether for attachment of the electronic monitoring device to the object to be monitored;
- attaching the electronic monitoring device to the object to be monitored using the tamper evident tether; and
- remotely monitoring the electronic monitoring device in order to monitor the location of the object;
- the method further including the steps of:
- providing the tamper evident tether with a unique identifier;
- providing an electronic data store remote from the electronic monitoring device;
- recording the unique identifier for the tether in the electronic data store, together with information about the object to be monitored and/or the associated electronic monitoring device; and
- performing an interrogation step at least once after the date on which the electronic monitoring device is first attached to the object, to determine whether the tether associated with the electronic monitoring device has the same unique identifier as that recorded in the electronic data store.

Since each tether is provided with its own unique identifier, the method enables the monitoring authority to determine whether the tether has been replaced (e.g. with an unauthorized tether). This enables the monitoring authority to determine whether a curfew or rule of curfew has been broken, for example.

In preferred embodiments, the unique identifier is a machine-readable identifier and the interrogation step involves the use of an interrogation machine configured for reading the machine-readable identifier, and wherein the machine is used to interrogate the tether to determine whether it has the same unique identifier as that recorded in the electronic data store. Preferably, the unique identifier is an RFID identifier and the interrogation machine includes an RFID reader configured for reading the RFID identifier associated with the tether.

There is further provided an electronic monitoring system comprising a plurality of electronic monitoring devices, a plurality of tamper evident tethers for selective attachment to the electronic monitoring devices, each tether including its own unique identifier for linking the tether to an object to be monitored and/or an associated electronic monitoring device, wherein the system further includes an electronic data store for recording the unique identifiers against information relating to an associated object to be monitored, and an interrogation tool configured for interrogation of the unique identifier on the tether, to update or verify the information recorded in the data store.

There is yet further provided an electronic monitoring apparatus comprising an electronic monitoring device for monitoring the location of an object, and a tamper evident tether for attachment of the device to an object to be monitored, wherein the tether includes a unique identifier for linking the tether to the object to be monitored, the apparatus further including an installation tool for attaching the electronic monitoring device to an object to be monitored, via one of said tethers, and wherein the tool is configured for recording the unique identifier from said tether during attachment of the device to the object to be monitored.

Other aspects and preferred features of the invention will be readily apparent from the claims and following description of preferred embodiments made, by way of example only, with reference to the following drawings, in which:

Figure 1:
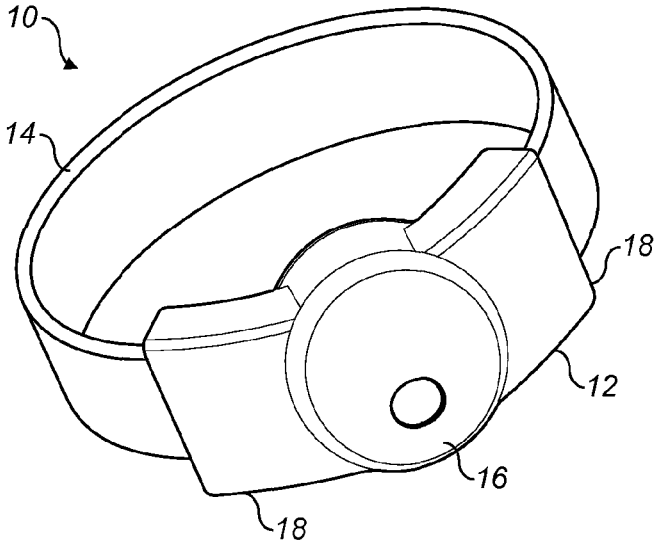
FIG. 1 shows an electronic monitoring apparatus according to an exemplary embodiment of the invention.
Figure 2:
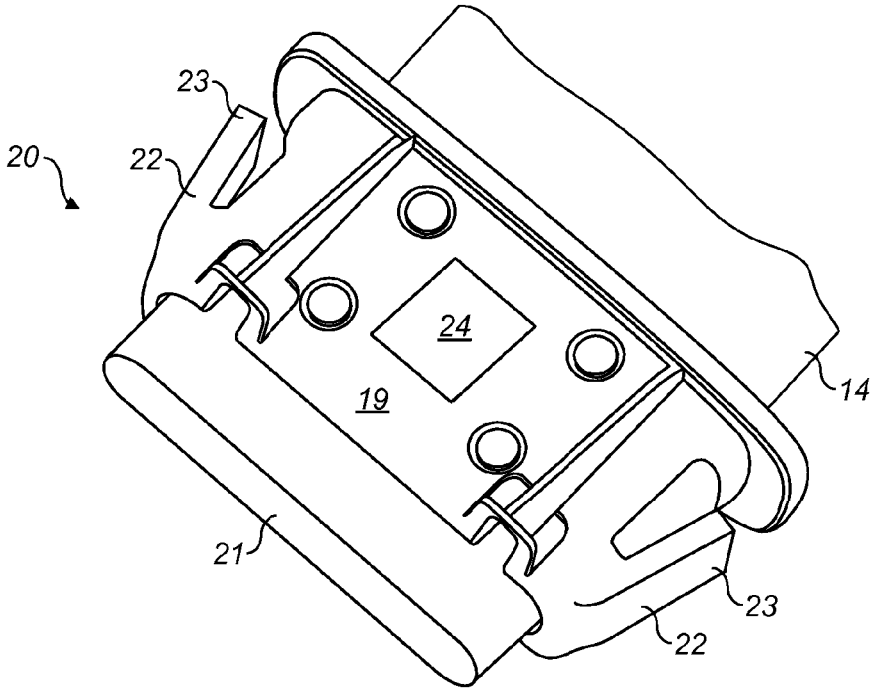
FIG. 2 shows a strap clip for use with the apparatus of FIG. 1.
Figure 3:
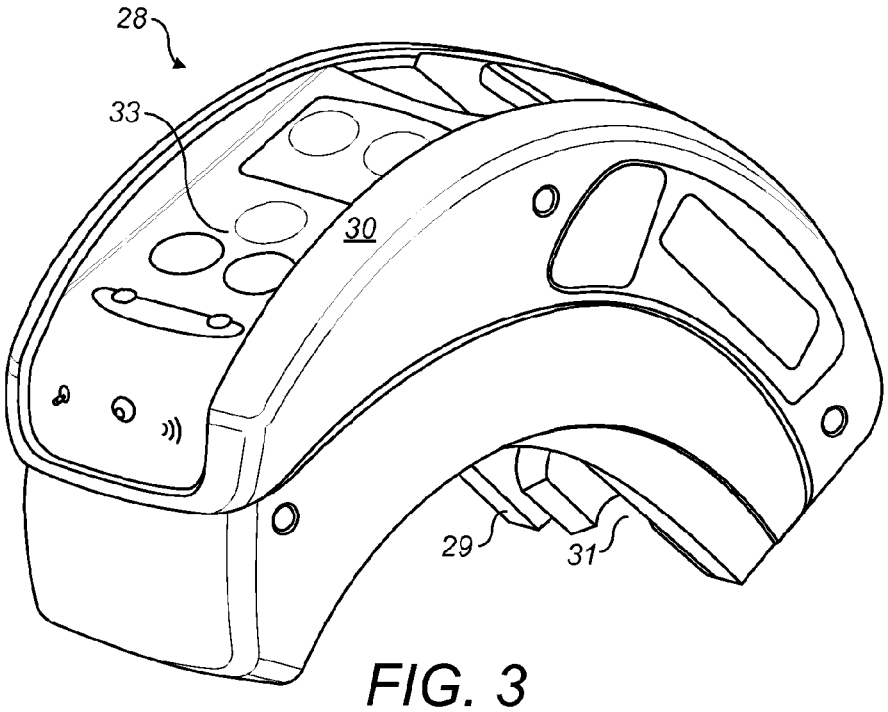
FIG. 3 shows a fitting and installation tool for use with the apparatus of FIGS. 1 and 2.
Figure 4A:
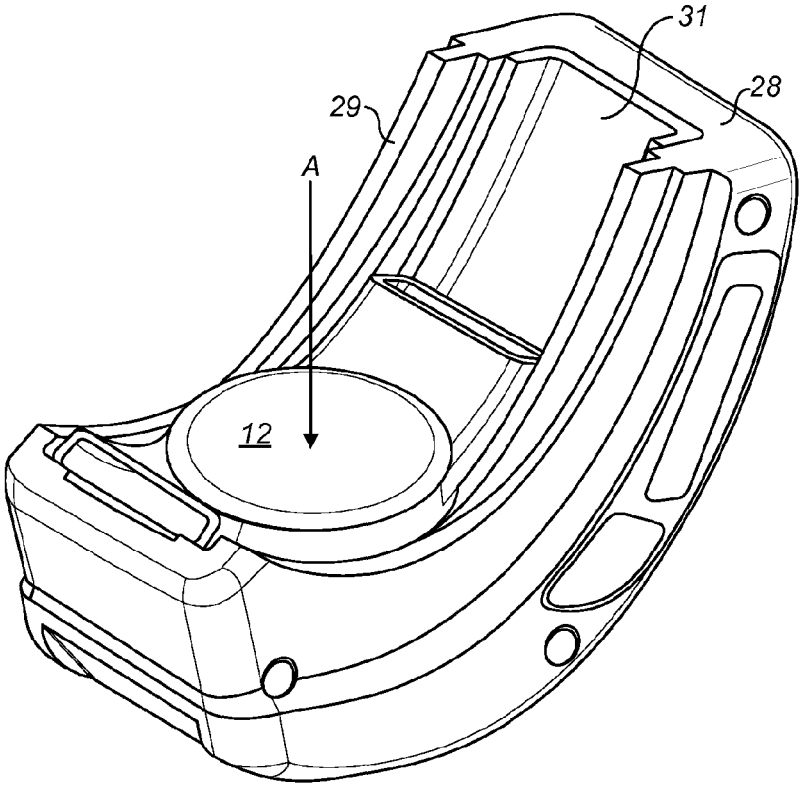
Figure 4B:
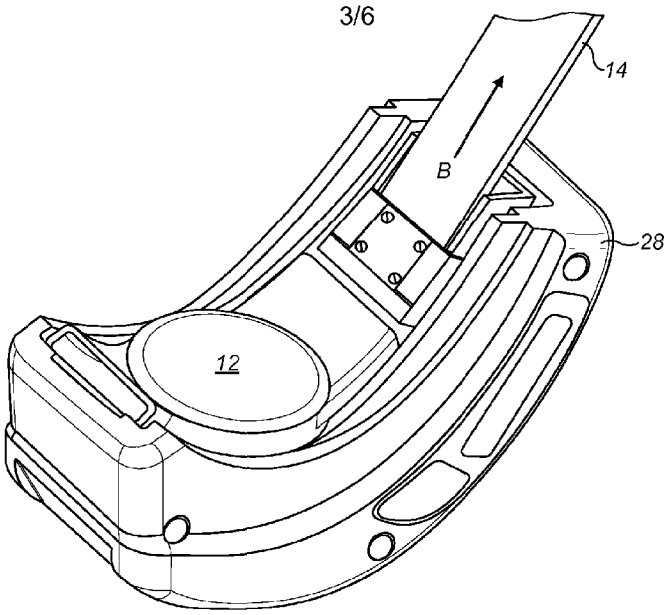
Figure 4C:
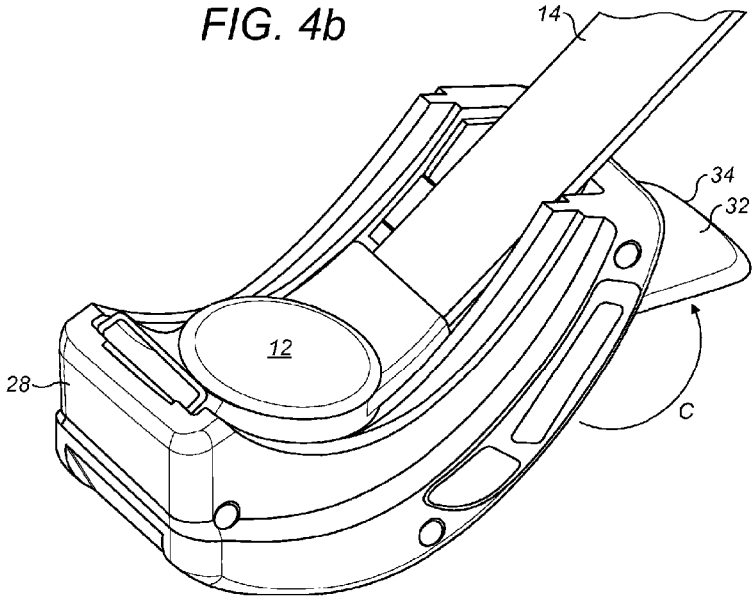
Figure 4D:
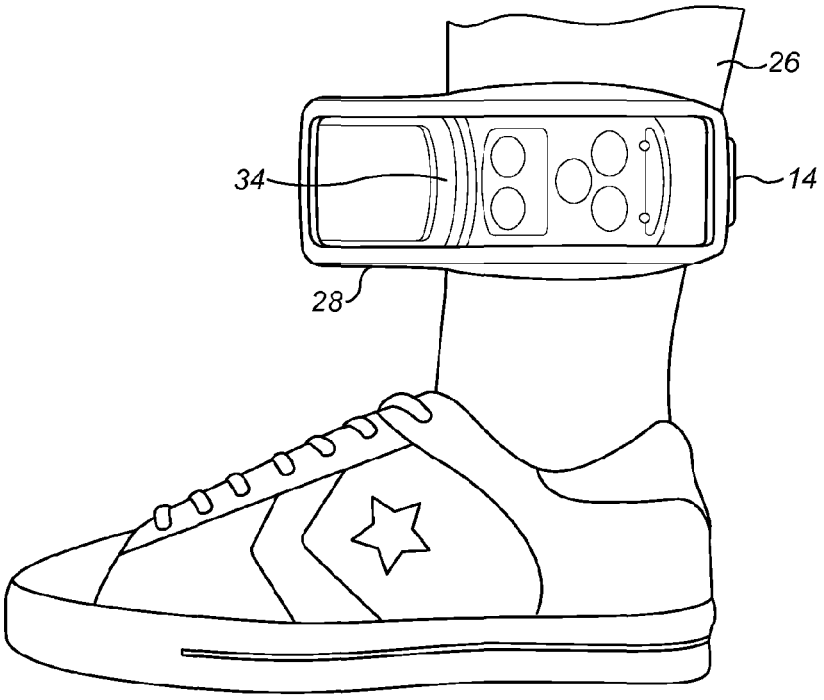
Figure 4E:
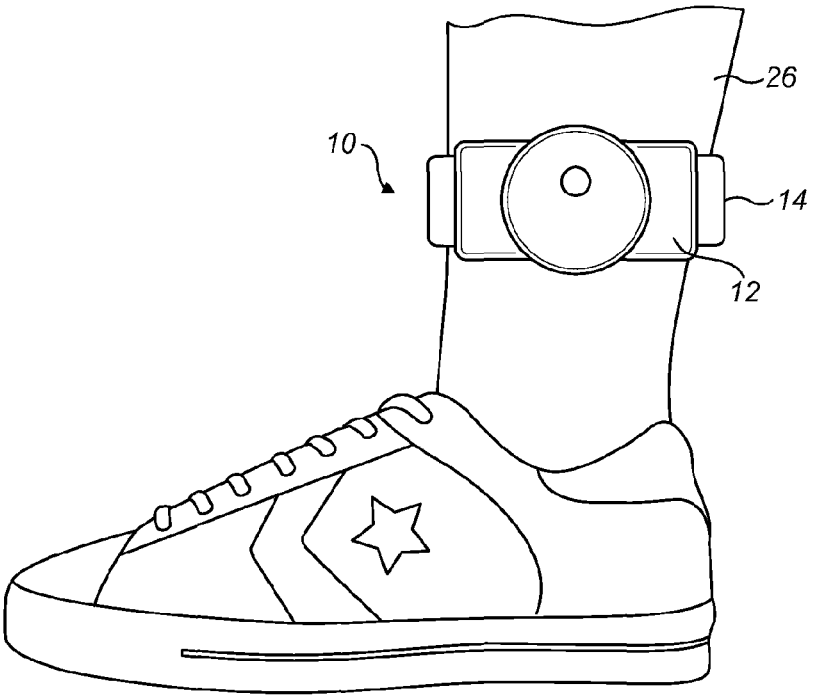
Figure 5:
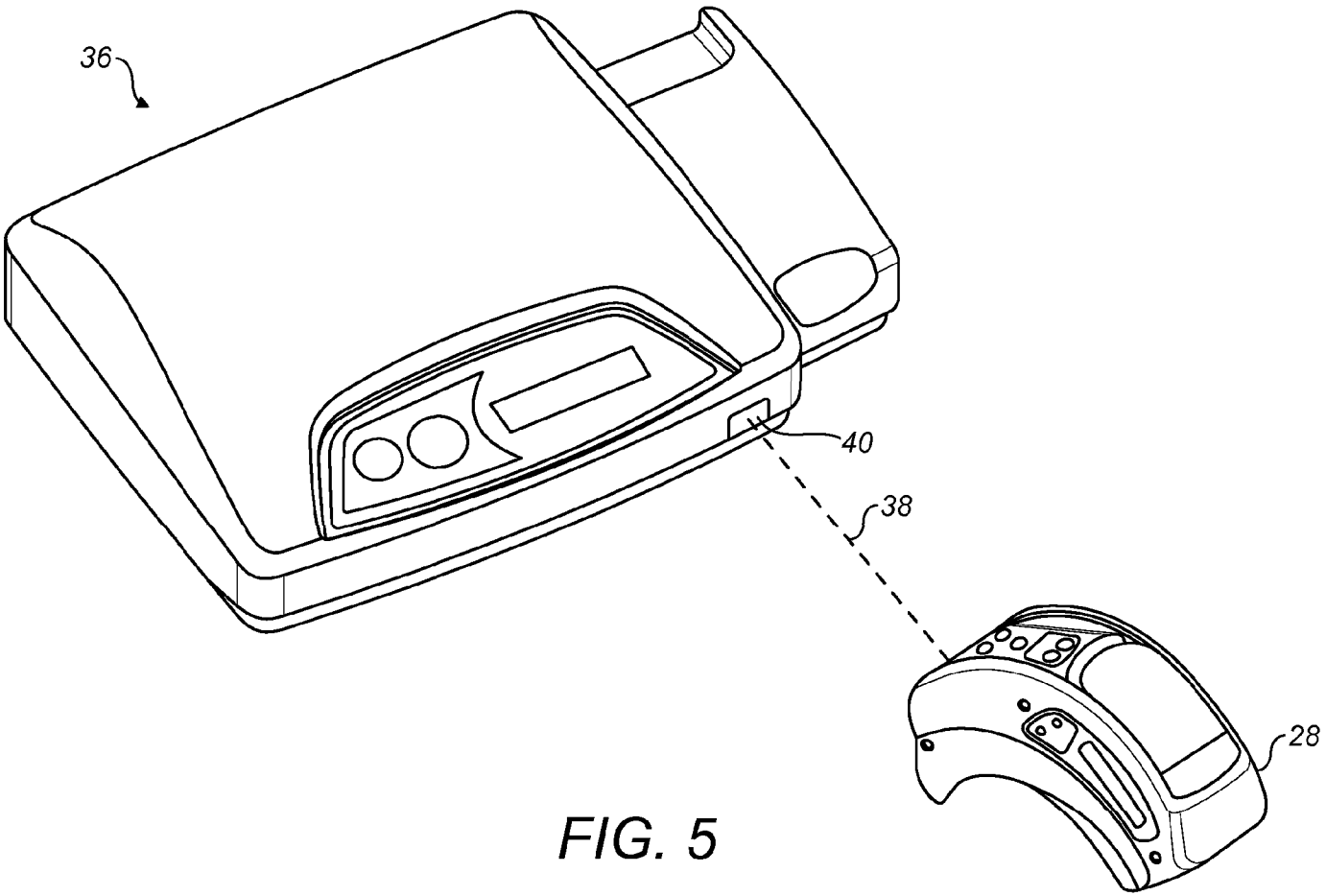

FIGS. 4*a* to 4*e* show installation steps of the apparatus of FIGS. 1 to 3;

FIG. 5 shows a data store for the apparatus of FIGS. 1 to 4; and

Figure 6:
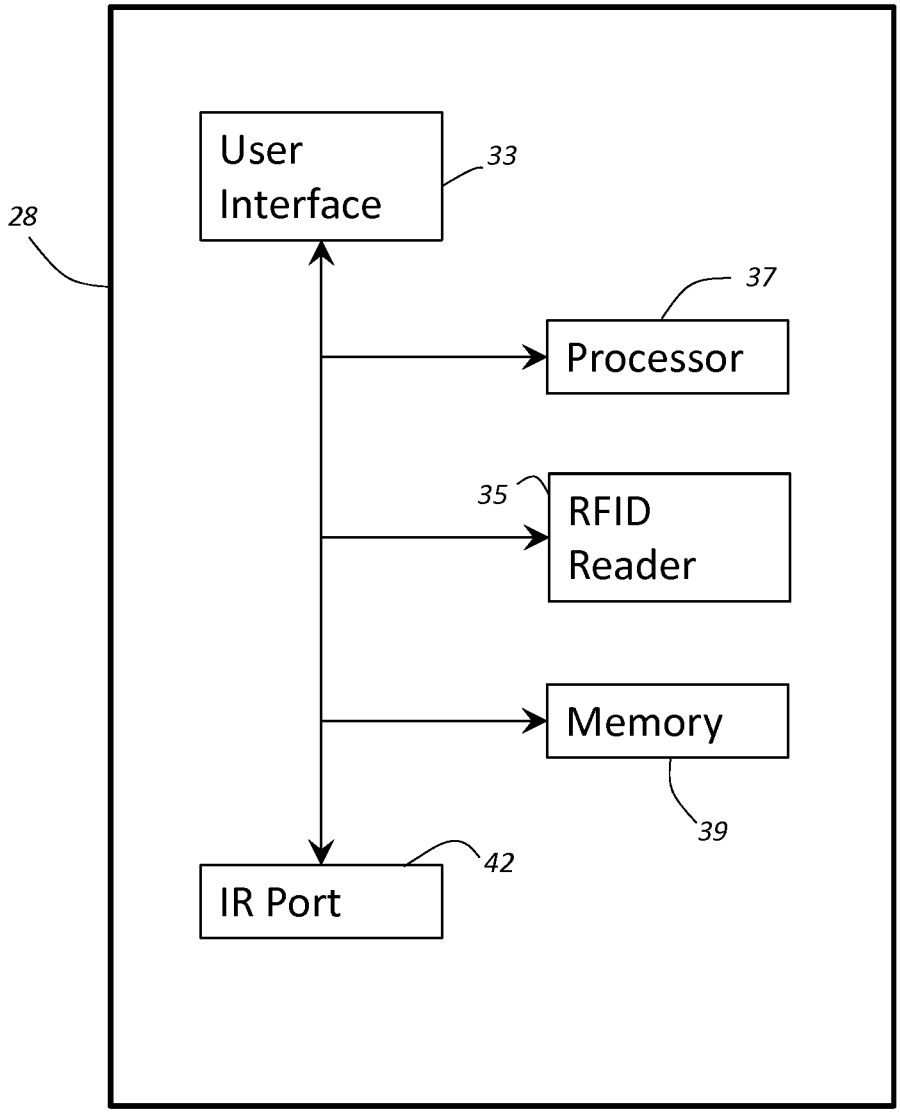

FIG. 6 is a schematic diagram of installation tool of FIG. 3.

With reference to FIG. 1, an electronic monitoring apparatus is indicated generally at 10. The electronic monitoring apparatus 10 consists of an electronic monitoring device in the form of a personal identification device (PID) 12, and a tether in the form of a tamper-evident strap 14. In exemplary embodiments the electronic monitoring device may include a GPS tracking device. The strap 14 is configured to attach the PID 12 to an object to be monitored, such as an offender. In this embodiment, the electronic monitoring apparatus 10 is intended for attachment to an offender's ankle 26 (e.g. as shown in FIGS. 4*d* and 4*e*), though it could be attached elsewhere, such as an offender's arm.

The PID 12 defines a housing 16 for a unique identifier, e.g. a radio wave transmitter (not shown), to enable the location of the PID 12 to be monitored remotely.

The PID 12 further includes two side portions 18 for attachment of the strap 14 to the PID 12. In this embodiment, each side portion 18 defines a female connection point (not shown) for receiving an end of the strap 14.

The PID 12 is a moulded component made from a suitable plastics material, such as polycarbonate, for example Makrolon 2405.

The strap 14 is a strip of tough, flexible material such as nylon, and may be reinforced with strands of a material such as Kevlar®.

In exemplary embodiments, each end of the strap 14 may include a clip for attachment of the strap 14 to the PID 12. An example is shown in FIG. 2, in which the clip 20 has a main body 19 with a free end 21 for insertion into a female connection point on the PID 12. The clip 20 includes two arms 22 which extend rearwardly from the free end 21. The arms 22 are arranged for resilient engagement with the PID 12, wherein the distal end 23 of each arm 22 can be used to lock the clip 20 in place on the PID 12.

Each clip 20 is provided with a passive radio frequency identification (RFID) tag 24 having a unique tag identifier. The RFID tags 24 emit data only when energised by a magnetic field, for example when read by an RFID reader.

FIG. 3 shows an installation tool 28 for installation of the electronic monitoring apparatus 10 on an object to be monitored, such as an offender. The tool 28 has a curved body with an inner face 29 and an outer face 30. The inner face 29 defines a channel 31, configured to receive a PID 12. The outer face 30 includes a user interface 33 for operating a processor 37 (FIG. 6) within the tool 28.

The tool 28 includes an installation mechanism indicated generally at 32 (see FIG. 4*c*), which includes a lever 34 movable from a first position to a second position, for use in fitting the clips 20 to the PID 12 (as will be described in more detail).

The tool 28 also includes an RFID reader 35 (FIG. 6) for energizing and reading data emitted by RFID tags 24, e.g. after one of the clips has been fitted into the channel 31 on the tool 28.

An example of installation of the electronic monitoring apparatus 10 will now be described with reference to FIGS. 4*a* to 4*e*.

As shown in FIG. 4*a*, installation begins with the PID 12 being fitted into the channel 31 in the direction of the arrow A. In exemplary embodiments, the channel 31 is configured to slidably receive the PID 12.

One of the clips 20 is then partially inserted into one of the connection points, as shown in FIG. 4*b*, and the strap 14 is pulled taut in the direction of the arrow B.

As shown in FIG. 4*c*, the lever 34 is pivoted in the direction indicated by arrow C, which causes the clip 20 to be forced fully into the connection point on the PID 12. In particular, the resilient arms 22 on the clip 20 move inwards to allow the clip 20 to pass into the connection point on the PID 12, and the distal end 23 of the arms 22 then provide locking engagement within the PID 12, once the clip has been fully inserted into the connection point. Thereafter, removal of the clip 20 is only possible by breaking part of the clip 20 or PID 12. If this were to happen, it would be clear that the electronic monitoring apparatus 10 had been tampered with.

When the clip 20 is fully inserted into the connection point on the PID 12, the RFID tag 24 of that clip 20 is positioned adjacent the RFID reader 35 (FIG. 6) of the tool 28. The RFID reader 35 is used at this stage to activate and read data (i.e. the unique tag identifier) from the RFID tag 24, and to store the data in memory 39 (FIG. 6) provided on the tool.

The PID 12 and the strap 14 are then removed from the tool 28. The strap 14 is placed around the object to which the electronic monitoring apparatus is to be attached, in this case the ankle of an offender. The PID 12 is once again fitted into the channel 31 of the tool 28, rotated by 180° relative to its previous position (see FIG. 4*d*). The clip 20 at the unattached end of the strap 14 is clamped into the PID 12 in the same way as the previous clip 20, and the tool 28 is used to activate the RFID tag 24, then to read and store the resultant data. The tool 28 is then removed, leaving the electronic monitoring apparatus securely attached to the ankle 26, as shown in FIG. 4*e*.

Following installation, the unique identifiers from the PID 12 and the two RFID tags 24 are stored together, e.g. with details of the offender to whom the electronic monitoring apparatus 10 has been attached, in an electronic data store. The information is wirelessly transmitted from the installation tool 28 to a remote monitoring unit 36, e.g. as shown in FIG. 5. The monitoring unit 36 includes an infrared port 40 where an infrared signal 38 transmitted by an infrared port 42 (FIG. 6) the tool 28 is received. The information is stored in a database within the monitoring unit 36, but is also transmitted to a central database (not shown) e.g. by the Global System for Mobile Communications (GSM).

When the time comes for removal of the PID 12, the strap 14 is severed with, for example, a pair of scissors (not shown). The clips 20 are then inserted in turn into the installation tool 28, and the tool's RFID reader is used to read the unique identifiers of each RFID tag 24. These identifiers can then be checked against the identifiers stored in the central database and/or the monitoring unit 36, to confirm that they are identical. If they are not, this is evidence of tampering. The only way the identifiers on removal of the PID 12 could be different from the identifiers as stored is if the strap 14 has been interfered with at some point and replaced with another strap 14. The unique identifiers being stored in two separate locations allows separate confirmation to be made, if required.

There are clear advantages to this method of checking for tampering. It prevents straps being removed and replaced with different straps, as this would be detected. Neither clip can be broken and replaced, as both clips 20 have RFID tags 24 with unique identifiers. This method also removes the need for constant monitoring of an electronic monitoring apparatus, as any tampering will be evident when the apparatus is removed from the offender. The strap 14 could also be removed (e.g. temporarily), and the RFID tags 24 checked, if tampering is suspected.

In alternative embodiments (not shown), only one of the clips 20 carries an RFID tag 24. One end of the strap 14 may be permanently attached to the PID 12. Other forms of electronic data storage may be used; for example, the monitoring unit 36 may contain information in a flat list in non-volatile RAM. Alternative methods of identifying the strap 14 may be used in addition to or instead of the RFID tags 24.

The invention claimed is:

1. A method of monitoring objects, the method comprising the steps of:

providing an electronic monitoring device for attachment to an object to be monitored;

providing a tamper-evident tether for attachment of the electronic monitoring device to the object to be monitored;

attaching the electronic monitoring device to the object to be monitored using the tether;

providing the tether with a unique identifier;

providing an electronic data store remote from the electronic monitoring device;

recording the unique identifier for the tether in the electronic data store, together with information about at least one of the group consisting of the object to be monitored and the associated electronic monitoring device; and performing an interrogation step at least once after the date on which the electronic monitoring device is first attached to the object, to determine whether the tether associated with the electronic monitoring device has the same unique identifier as that recorded in the electronic data store;

wherein the unique identifier is provided at a first end of the tether, and the method further comprises the step of fitting said first end to the electronic monitoring device, so that the unique identifier is hidden within the electronic monitoring device.

2. The method of claim 1 wherein:

the tether is a separate item from the electronic monitoring device; and the method further comprises the steps of, attaching the tether to the electronic monitoring device, and then using the tether to attach the electronic monitoring device to the object to be monitored.

3. The method of claim 2 wherein:

the unique identifier is recorded in the data store together with said information during or after attachment of the tether to the electronic monitoring device.

4. The method of claim 2 wherein:

the electronic monitoring device includes a housing having a connection point for connection of a free end of the tether; and the method further comprises the step of fixedly receiving the free end of the tether at the connection point.

5. The method of claim 4 wherein:

the unique identifier is enclosed in the housing after the step of fixedly receiving the free end of the tether at the connection point.

6. The method of claim 1 further comprising the step of:

attaching the tether and the electronic monitoring device to the object to be monitored using an installation tool, wherein the tool includes a reader configured for electronically reading the unique identifier during or after attachment of the tether to the device.

7. The method of claim 6 wherein:

the installation tool is configured to communicate with the data store to update or verify the information stored in the data store.

8. The method of claim 6 wherein the step of attaching the electronic monitoring device to the object to be monitored further comprises the steps of:

inserting the electronic monitoring device into the installation tool;

inserting an end of the tether into the electronic monitoring device; and using the installation tool to secure the end of the tether into the electronic monitoring device.

9. The method of claim 1 wherein:

the tether has at least one clip for attachment to the electronic monitoring device.

10. The method of claim 9 wherein:

the unique identifier is provided on the clip.

11. The method of claim 1 wherein:

the unique identifier is a machine-readable identifier;

the interrogation step involves the use of an interrogation tool configured for reading the machine-readable identifier; and the tool is used to interrogate the tether to determine whether it has the same unique identifier as that recorded in the electronic data store.

12. The method of claim 11 wherein:

the unique identifier is an RFID identifier; and the interrogation tool includes an RFID reader configured for reading the RFID identifier associated with the tether.

13. The method of claim 1 further comprising:

remotely monitoring the electronic monitoring device in order to monitor the location of the object.

14. An electronic monitoring system comprising:

a plurality of electronic monitoring devices;

a plurality of tamper-evident tethers, each said tether operable for selectively attaching one of said plurality of electronic monitoring devices to an associated object to be monitored, each said tether including a unique identifier for relating the tether to at least one from the group consisting of the associated object to be monitored and said one of said plurality of electronic monitoring devices;

an electronic data store for recording the unique identifiers in relation to information about the associated objects to be monitored; and an interrogation tool configured for interrogation of the unique identifiers of the tethers, to update or verify the information recorded in the data store;

wherein, the unique identifier is provided at a first end of the tether, and the method further comprises the step of fitting said first end to the electronic monitoring device, so that the unique identifier is hidden within the electronic monitoring device.

15. An electronic monitoring apparatus comprising:

an electronic monitoring device for monitoring the location of an object to be monitored;

a tamper-evident tether for attachment of the device to the object to be monitored, the tether including a unique identifier for relating the tether to the object to be monitored; and an installation tool for attaching the electronic monitoring device to the object to be monitored via the tether, the tool being configured for recording the unique identifier from said tether during attachment of the device to the object to be monitored;

wherein, the unique identifier is provided at a first end of the tether, and the method further comprises the step of fitting said first end to the electronic monitoring device, so that the unique identifier is hidden within the electronic monitoring device.

* * * * *